US010294907B2

(12) United States Patent
Hashida et al.

(10) Patent No.: US 10,294,907 B2
(45) Date of Patent: May 21, 2019

(54) HIGH PRESSURE FUEL SUPPLY PUMP

(71) Applicant: HITACHI AUTOMOTIVE SYSTEMS, LTD., Ibaraki (JP)

(72) Inventors: Minoru Hashida, Hitachinaka (JP); Hiroyuki Yamada, Hitachinaka (JP); Satoshi Usui, Hitachinaka (JP); Kenichirou Tokuo, Hitachinaka (JP); Masayuki Suganami, Hitachinaka (JP); Atsushi Hohkita, Hitachinaka (JP); Masamichi Yagai, Hitachinaka (JP)

(73) Assignee: HITACHI AUTOMOTIVE SYSTEMS, LTD., Ibaraki (JP)

( * ) Notice: Subject to any disclaimer, the term of this patent is extended or adjusted under 35 U.S.C. 154(b) by 124 days.

(21) Appl. No.: 15/506,040

(22) PCT Filed: Jun. 29, 2015

(86) PCT No.: PCT/JP2015/068602
§ 371 (c)(1),
(2) Date: Feb. 23, 2017

(87) PCT Pub. No.: WO2016/031378
PCT Pub. Date: Mar. 3, 2016

(65) Prior Publication Data

US 2017/0248110 A1 Aug. 31, 2017

(30) Foreign Application Priority Data

Aug. 28, 2014 (JP) ..... 2014-173866

(51) Int. Cl.
*F02M 59/02* (2006.01)
*F02M 59/36* (2006.01)
(Continued)

(52) U.S. Cl.
CPC ..... *F02M 59/366* (2013.01); *F02M 59/025* (2013.01); *F02M 59/368* (2013.01);
(Continued)

(58) Field of Classification Search
CPC .. F02M 59/366; F02M 59/025; F02M 59/368; F02M 59/466; F02M 63/0022;
(Continued)

(56) References Cited

U.S. PATENT DOCUMENTS

2007/0194151 A1 8/2007 Hayatani et al.
2008/0011886 A1 1/2008 Abe et al.
(Continued)

FOREIGN PATENT DOCUMENTS

DE 102009046088 A1 5/2011
JP 2007-218204 A 8/2007
(Continued)

OTHER PUBLICATIONS

Extended European Search Report dated Feb. 26, 2018 for the European Patent Application No. 15836661.7.
(Continued)

*Primary Examiner* — Joseph J Dallo
*Assistant Examiner* — Yi-Kai Wang
(74) *Attorney, Agent, or Firm* — Volpe and Koenig, P.C.

(57) ABSTRACT

A high pressure fuel supply pump includes: an electromagnetic suction valve that adjusts an amount of fuel sucked into a pressuring chamber; a discharge valve that discharges the fuel from the pressuring chamber; and a plunger that makes a reciprocating motion in the pressuring chamber. The electromagnetic suction valve includes an electromagnetic coil, a suction valve, and a movable portion that is able to close the suction valve by a magnetic force when the electromagnetic coil is energized. The movable portion includes an anchor that is driven to close the suction valve
(Continued)

by the magnetic force and stops at a fixed member, and a rod that is driven with the anchor and is able to move even after the anchor stops. The electromagnetic suction valve includes a first and second springs that bias the suction valve in closed and open direction, respectively, and a third spring in the rod.

12 Claims, 7 Drawing Sheets

(51) Int. Cl.

| | |
|---|---|
| ***F02M 59/46*** | (2006.01) |
| ***F04B 19/22*** | (2006.01) |
| ***F04B 53/10*** | (2006.01) |
| ***F02M 63/00*** | (2006.01) |
| *F04B 53/14* | (2006.01) |
| *F04B 53/16* | (2006.01) |

(52) U.S. Cl.
CPC ..... *F02M 59/466* (2013.01); *F02M 63/0022* (2013.01); *F04B 19/22* (2013.01); *F04B 53/10* (2013.01); *F02M 2200/50* (2013.01); *F04B 53/14* (2013.01); *F04B 53/16* (2013.01)

(58) Field of Classification Search
CPC ..... F02M 2200/50; F04B 19/22; F04B 53/14; F04B 53/16
USPC ..... 123/446
See application file for complete search history.

(56) References Cited

U.S. PATENT DOCUMENTS

| | | | | |
|---|---|---|---|---|
| 2009/0120412 | A1* | 5/2009 | Tokuo | F02M 59/102 123/506 |
| 2009/0188996 | A1 | 7/2009 | Abe et al. | |
| 2011/0097228 | A1* | 4/2011 | Tokuo | F02M 37/0047 417/505 |
| 2013/0052064 | A1* | 2/2013 | Oikawa | F04B 11/0016 417/540 |
| 2013/0214066 | A1 | 8/2013 | Suzuki et al. | |
| 2014/0099215 | A1* | 4/2014 | Kawano | F02M 59/368 417/279 |
| 2014/0255219 | A1* | 9/2014 | Lucas | F04B 1/0452 417/282 |

FOREIGN PATENT DOCUMENTS

| | | | | |
|---|---|---|---|---|
| JP | 2007-218205 | A | | 8/2007 |
| JP | 2008-019785 | A | | 1/2008 |
| JP | 2010-169083 | A | | 8/2010 |
| JP | 2010-281248 | A | | 12/2010 |
| JP | 2012251447 | A | * | 6/2011 |
| JP | 2012-251447 | A | | 12/2012 |
| JP | 2013-151915 | A | | 8/2013 |
| JP | 2013-199924 | A | | 10/2013 |
| JP | 5537498 | B2 | | 5/2014 |
| JP | 2014-134208 | | | 7/2014 |

OTHER PUBLICATIONS

International Search Report for WO 2016/031378 A1, dated Sep. 15, 2015.

* cited by examiner

HIGH PRESSURE FUEL SUPPLY PUMP

TECHNICAL FIELD

The present invention relates to a high pressure fuel supply pump that pumps fuel to a fuel injection valve of an internal combustion engine, and particularly to a high pressure fuel supply pump equipped with an electromagnetic suction valve which adjusts an amount of discharging fuel.

BACKGROUND ART

In a direct injection type of an internal combustion engine which directly injects the fuel into a fuel chamber among the internal combustion engines of an automobile, there is widely used a high pressure fuel supply pump equipped with an electromagnetic suction valve which pressurizes the fuel at a high pressure and discharges a desired amount of the fuel.

As an example of the high pressure fuel supply pump equipped with the electromagnetic suction valve, PTL 1 discloses a high pressure fuel supply pump in which a movable component of the electromagnetic suction valve moved by an electromagnetic force is divided into two parts (anchor and rod). When the electromagnetic force is loaded, only the anchor is used to generate collision energy when the movable portion comes into conflict with a fixed portion (core) in order to reduce collision noises.

CITATION LIST

Patent Literature

PTL 1: JP 5537498 B2

SUMMARY OF INVENTION

Technical Problem

However, in the above related art, the anchor separates from the core by a biasing force of a spring which is biasing the rod, and the rod simultaneously moving together with the anchor comes into conflict with the valve member and stops moving when the current is cut to make the high pressure fuel supply pump enter a discharge process, and the electromagnetic force is released; however, the anchor keeps moving. Therefore, the anchor comes into conflict with another member to generate an abnormal sound. In addition, in a case where the anchor and the core separate over an allowable range and the current is supplied, an electromagnetic attraction force becomes insufficient, and thus the energy to move the anchor in a direction approaching the core is not obtained. Therefore, it is not possible to control a desired flow rate. These problems are remarkably exhibited in a large capacity of pump such that the spring force for biasing the rod is increased, and a movable amount of the valve and the rod is increased.

An object of the invention is to provide a high pressure fuel supply pump equipped with an electromagnetic suction valve which reduces collision noises caused by the electromagnetic suction valve, and obtains controllability on a desired amount of flow rate.

Solution to Problem

As described above, in the present invention, a high pressure fuel supply pump, includes: an electromagnetic suction valve that adjusts an amount of fuel sucked into a pressuring chamber; a discharge valve that discharges the fuel from the pressuring chamber; and a plunger that is able to make a reciprocating motion in the pressuring chamber, wherein the electromagnetic suction valve includes an electromagnetic coil, a suction valve, and a movable portion that is able to be operated in a direction closing the suction valve by a magnetic attraction force when the electromagnetic coil is energized, wherein the movable portion includes an anchor portion that is driven in a direction closing the suction valve by the magnetic attraction force and comes into conflict with a fixed member to stop moving, and a rod portion that is driven in conjunction with the anchor portion and is able to keep its moving even after the anchor portion stops moving, and wherein the electromagnetic suction valve includes a first spring that biases the suction valve in a direction to be closed, a second spring that biases the suction valve through the rod portion in a direction to be opened, and a third spring in the anchor portion that gives the rod portion a force pressing the rod portion.

Advantageous Effects of Invention

According to the invention configured as described above, the anchor stops at a defined position by an anchor biasing spring of the invention after the electromagnetic force is released and the rod moves toward the suction valve by a rod biasing spring, comes into conflict with the suction valve, and stops even when the anchor keeps moving by an inertia force. Therefore, it is possible to provide a pump which does not occur an abnormal sound since the anchor does not come into conflict with another member, and also possible to control a desired flow rate by positioning the anchor at an attractable position.

DESCRIPTION OF EMBODIMENTS

Figure 1:
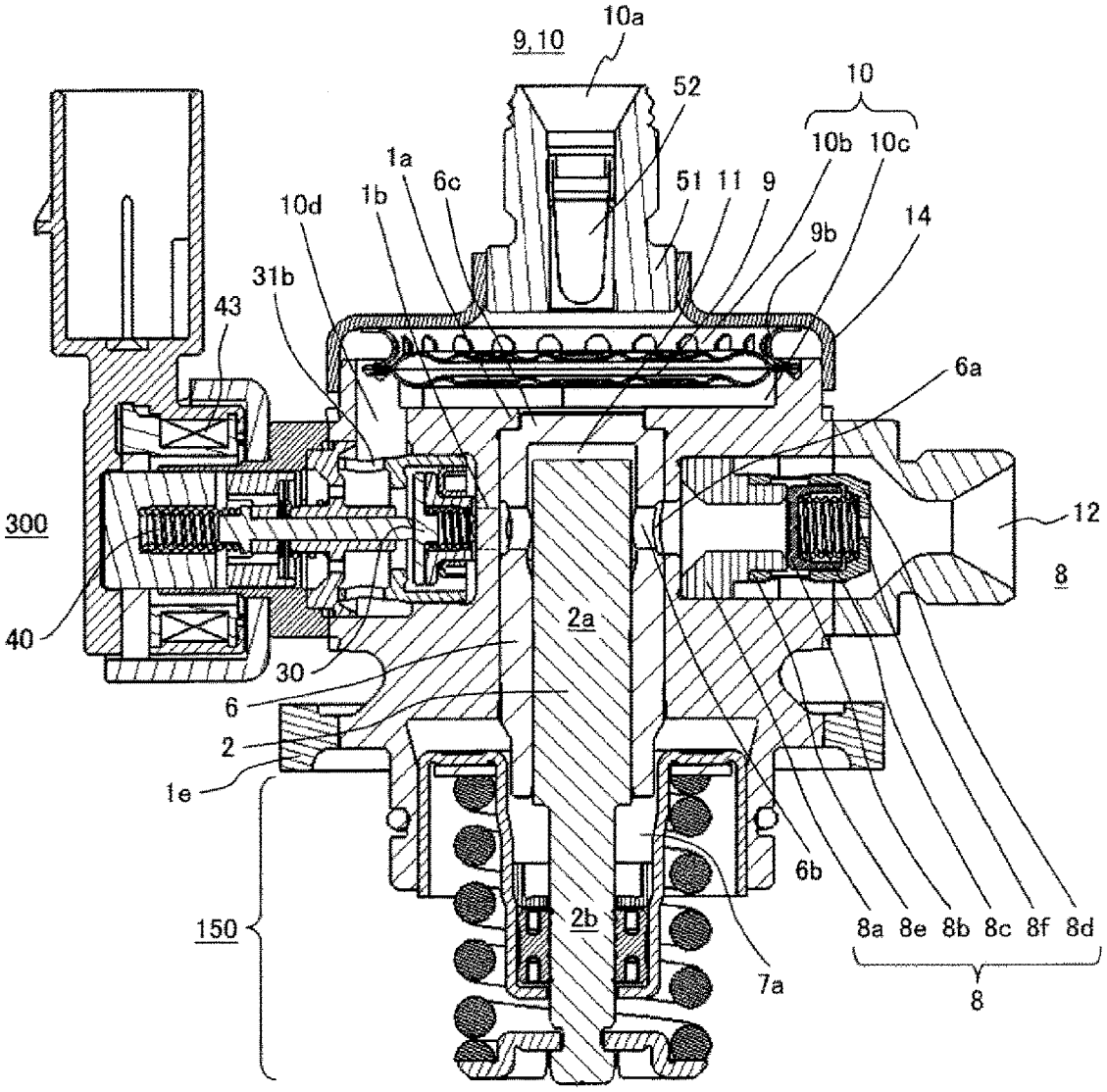
FIG. 1 is a diagram illustrating a specific example of a high pressure fuel supply pump body 1 which is mechanically integrated.

Hereinafter, the invention will be described in detail on the basis of embodiments illustrated in the drawings.

First Embodiment

Figure 2:
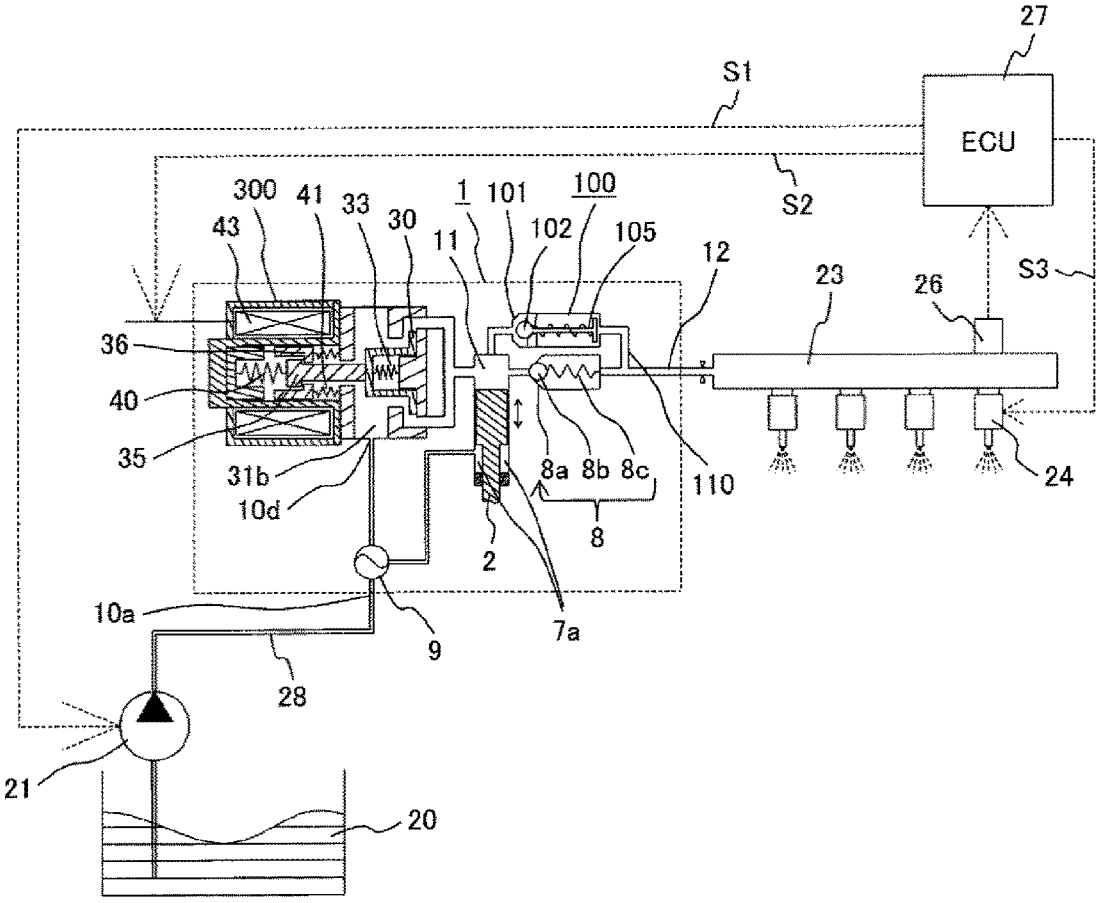
FIG. 2 is a diagram illustrating an exemplary entire configuration of a fuel supply system which includes the high pressure fuel supply pump to which the invention is applicable.

FIG. 2 is a diagram illustrating the entire exemplary configuration of a fuel supply system which includes a high pressure fuel supply pump to which the invention is applicable. The configuration and the operation of the entire system will be first described using the drawing.

In FIG. 2, a portion 1 surround by a broken line illustrates the high pressure fuel supply pump body. The mechanisms and components illustrated in the center of the broken line show that they are integrally assembled with the high pressure fuel supply pump body 1. The fuel is fed to the high pressure fuel supply pump body 1 from a fuel tank 20 through a feed pump 21, and the pressurized fuel is sent from the high pressure fuel supply pump body 1 toward an injector 24. An engine control unit 27 acquires a fuel pressure from a pressure sensor 26, and controls the feed pump 21, an electromagnetic coil 43 in the high pressure fuel supply pump body 1, and the injector 24 to optimize the fuel pressure.

In FIG. 2, first, the fuel of the fuel tank 20 is pumped up by the feed pump 21 on the basis of a control signal S1 from the engine control unit 27, and is pressured to an appropriate feed pressure and sent to a low pressure fuel inlet (suction joint) 10*a* of the high pressure fuel supply pump 1 through a suction pipe 28. The fuel passed through the low pressure fuel inlet 10*a* reaches a suction port 31*b* of an electromagnetic suction valve 300 which forms a capacity variable mechanism through a pressure pulsation reduction mechanism 9 and a suction passage 10*d*. Furthermore, the pressure pulsation reduction mechanism 9 communicates with an annular low pressure fuel chamber 7*a* which makes pressure variable in conjunction with a plunger 2 making a reciprocating motion by a cam mechanism (not illustrated) of the engine thereby to reduce the pressure pulsation of the fuel sucked to the suction port 31*b* of the electromagnetic suction valve 300.

The fuel flowing into the suction port 31*b* of the electromagnetic suction valve 300 passes through a suction valve 30 and flows into a pressuring chamber 11. Furthermore, the position of the suction valve 30 is determined when the electromagnetic coil 43 in the high pressure fuel supply pump body 1 is controlled on the basis of a control signal S2 from the engine control unit 27. In the pressuring chamber 11, a reciprocating force is applied to the plunger 2 by the cam mechanism (not illustrated) of the engine. Through the reciprocating motion of the plunger 2, the fuel is sucked from the suction valve 30 in a falling process of the plunger 2. The fuel sucked in the rising process of the plunger 2 is pressured. Then, the fuel is pumped to a common rail 23 equipped with the pressure sensor 26 through a discharge valve mechanism 8. Thereafter, the injector 24 injects the fuel to the engine on the basis of a control signal S3 from the engine control unit 27.

Furthermore, the discharge valve mechanism 8 provided at the output port of the pressuring chamber 11 is configured by a discharge valve seat 8*a*, a discharge valve 8*b* which comes into contact with and separates from the discharge valve seat 8*a*, and a discharge valve spring 8*c* which biases the discharge valve 8*b* toward the discharge valve seat 8*a*. According to the discharge valve mechanism 8, the internal pressure of the pressuring chamber 11 is higher than that in a discharge passage 12 on the downstream side of the discharge valve 8*b*. When the discharge valve spring 8*c* overcomes a predetermined resistance, the discharge valve 8*b* is opened, and the pressurized fuel is pumped and supplied from the pressuring chamber 11 toward the discharge passage 12.

In addition, the respective components of the electromagnetic suction valve 300 of FIG. 2 include a suction valve 30, a rod 35 which is connected to the suction valve 30, a suction valve spring 33, a rod biasing spring 40, and an anchor biasing spring 41. According to such a mechanism, the suction valve 30 is driven in a closing direction by the suction valve spring 33, and driven in an opening direction by the rod biasing spring 40 through the rod 35 connected to the suction valve 30. A valve position of the suction valve 30 is controlled by the electromagnetic coil 43. Furthermore, an anchor 36 and the anchor biasing spring 41 are provided in order to control the valve position in a case where the suction valve 30 is opened.

In this way, the electromagnetic coil 43 in the high pressure fuel supply pump body 1 is controlled on the basis of the control signal S2 given to the electromagnetic suction valve 300 by the engine control unit 27. The high pressure fuel supply pump 1 discharges the fuel as much as a desired supply amount of fuel pumped to the common rail 23 through the discharge valve mechanism 8.

In addition, the pressuring chamber 11 and the common rail 23 communicate with each other through a relief valve 100 in the high pressure fuel supply pump 1. The relief valve 100 is a valve mechanism which is disposed in parallel with the discharge valve mechanism 8. The relief valve 100 prevents an abnormally high pressure state in the common rail 23 by opening the relief valve 100 to make the fuel return into the pressuring chamber 11 of the high pressure fuel supply pump 1 when the pressure in the common rail 23 rises equal to or more than a predetermined pressure of the relief valve 100.

The relief valve 100 forms a high pressure passage 110 which communicates between the discharge passage 12 on the downstream side of the discharge valve 8*b* in the high pressure fuel supply pump body 1 and the pressuring chamber 11. Herein, the discharge valve 8*b* is provided as a bypass. In the high pressure passage 110, a relief valve 102 is provided to control the fuel to flow only one direction from the discharge passage to the pressuring chamber 11. The relief valve 102 is pushed to a relief valve seat 101 by a relief spring 105 which generates a pressing force. The relief valve 102 separates from the relief valve seat 101 when a differential pressure between the pressuring chamber 11 and the high pressure passage 110 rises equal to or more than a pressure defined by the relief spring 105, and so as to be opened.

As a result, in a case where the common rail 23 becomes an abnormally high pressure due to a failure of the electromagnetic suction valve 300 of the high pressure fuel supply pump 1, and thus the differential pressure between the discharge passage 110 and the pressuring chamber 11 rises equal to or more than a pressure to open the relief valve 102, the relief valve 102 is opened. The fuel having the abnormally high pressure returns from the discharge passage 110 to the pressuring chamber 11, so that the highly pressured pipe such as the common rail 23 is protected.

FIG. 2 illustrates an example of the entire configuration of the fuel supply system which includes the high pressure fuel supply pump. The high pressure fuel supply pump body 1 surrounded by the broken line is mechanically integrated which has been already described.

FIG. 1 is a diagram illustrating a specific example of the high pressure fuel supply pump body 1 which is mechanically integrated. As illustrated in the drawing, the plunger 2 moving in the reciprocating motion (vertical motion in this case) in a height direction in the center of the drawing by the cam mechanism (not illustrated) of the engine is disposed in a cylinder 6. The pressuring chamber 11 is formed in the cylinder 6 in the upper portion of the plunger.

Figure 3:
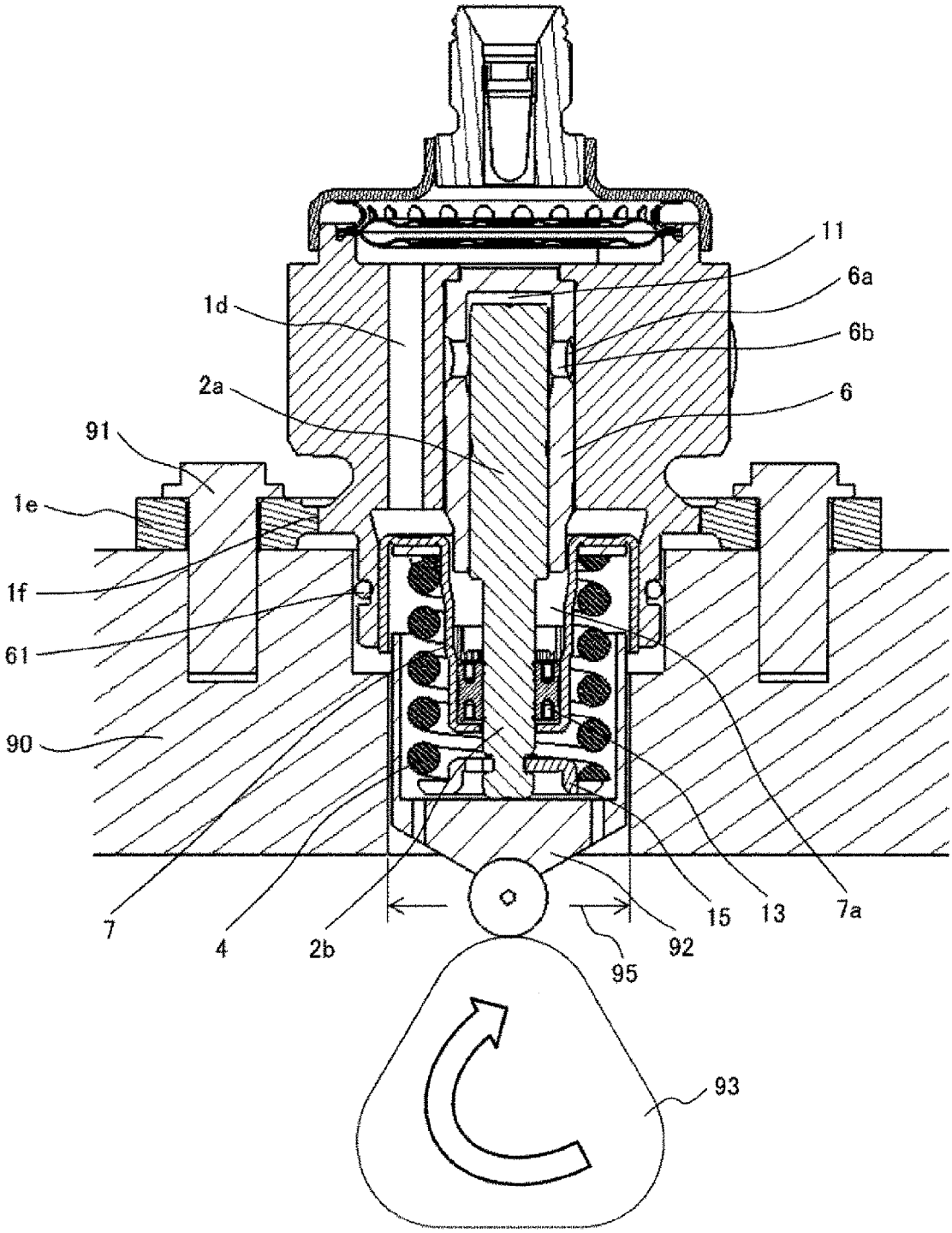
FIG. 3 is a diagram illustrating a state where an attachment root portion 150 is embedded and fixed into an internal combustion engine.

In addition, as illustrated in the drawing, the mechanisms of the electromagnetic suction valve 300 are disposed on the left side from the center in the drawing. The discharge valve mechanism 8 is disposed on the right side from the center in the drawing. In addition, the low pressure fuel inlet 10*a*, the pressure pulsation reduction mechanism 9, and the suction passage 10*d* are disposed as the mechanisms for sucking the fuel in the upper portion of the drawing. Furthermore, a mechanism 150 of the plunger on the side near the internal combustion engine is illustrated in the lower portion from the center of FIG. 1. The mechanism 150 of the plunger on the side near the internal combustion engine is a portion embedded in and fixed to the internal combustion engine as illustrated in FIG. 3, and thus herein called an attachment root portion. Furthermore, the mechanism of the relief valve 100 is not illustrated in the cross-sectional view of FIG. 1. While the mechanism of the relief valve 100 can be illustrated in a cross-sectional view from another angle, the mechanism has no direct relation to the invention, and thus the description and illustration thereof will be omitted.

The detailed descriptions of the respective portions of FIG. 2 will be given below. First, the description will be given about the attaching of the attachment root portion using FIG. 3. FIG. 3 illustrates a state in which the attachment root portion (the mechanism of the plunger on the side near the internal combustion engine) 150 is embedded in and fixed to the internal combustion engine. In this case, FIG. 3 is illustrated focusing on the attachment root portion 150, and thus the other portions are not illustrated. In FIG. 3, a thick portion of a cylinder head 90 of the internal combustion engine is illustrated. In the cylinder head 90 of the internal combustion engine, the attachment root portion attaching hole 95 is formed in advance. The attachment root portion attaching hole 95 is configured to have a 2-stage diameter according to the shape of the attachment root portion 150, and the attachment root portion 150 is fitted to the plunger root attaching hole 95.

Then, the attachment root portion 150 is air-tightly fixed to the cylinder head 90 of the internal combustion engine. In an exemplary air-tightly fixing arrangement of FIG. 3, the high pressure fuel supply pump comes into tight contact with the flat surface of the cylinder head 90 of the internal combustion engine using a flange 1*e* provided in the pump body 1, and is fixed by a plurality of bolts 91. Then, the attaching flange 1*e* is bonded by welding the entire periphery to the pump body 1 using a welding portion 1*f* so as to form a circular fixing portion. In this embodiment, a laser welding is used for welding the welding portion 1*f*. In addition, an 0 ring 61 is fitted to the pump body 1 for sealing between the cylinder head 90 and the pump body 1 to prevent engine oil from being leaked to the outside.

In this way, the plunger root portion 150 which is air-tightly fixed is provided with a tappet 92 which converts the rotation motion of a cam 93 attached to a cam shaft of the internal combustion engine into a vertical motion in the lower end 2*b* of the plunger 2, and transfers the vertical motion to the plunger 2. The plunger 2 is pressed to the tappet 92 by a spring 4 through a retainer 15. In this way, the plunger 2 makes the reciprocating motion in a vertical direction along with the rotation motion of the cam 93.

In addition, a plunger seal 13 held on the lower portion of the inner periphery of a seal holder 7 is provided to come into slidable contact with the outer periphery of the plunger 2 in the lower portion of the cylinder 6 in the drawing. The plunger seal is sealed even in a case where the plunger 2 slides on the fuel of the annular low pressure fuel chamber 7*a*, and the fuel is prevented from leaking to the outside. At the same time, a lubricating oil (and the engine oil) is prevented from lubricating the sliding portion in the internal combustion engine flows into the pump body 1.

As illustrated in FIG. 3, the air-tightly fixed plunger root portion 150 is configured such that the plunger 2 thereof makes the reciprocating motion in the cylinder 6 along the rotation motion of the internal combustion engine. Returning to FIG. 1, the movements of the respective portions along the reciprocating motion will be described. In FIG. 1, the cylinder 6 which guides the reciprocating motion of the plunger 2 is attached to the high pressure fuel supply pump 1. The cylinder 6 is formed in a bottomed cylindrical shape in its end portion (the upper side in FIG. 1) to form the pressuring chamber 11 in the inner portion thereof. Furthermore, the pressuring chamber 11 is provided with an annual groove 6*a* on the outer periphery and a plurality of communication holes 6*b* to communicate between the annual groove 6*a* and the pressuring chamber in order to communicate with the electromagnetic suction valve 300 for supplying the fuel and with the discharge valve mechanism 8 for discharging the fuel from the pressuring chamber 11 to the discharge passage.

The outer periphery of the cylinder 6 is pressed fit into the high pressure fuel supply pump 1 and fixed, and is sealed in the cylinder surface of the pressed portion not to leak the fuel pressed from the gap with respect to the high pressure fuel supply pump 1 to a low pressure side. In addition, a small diameter portion 6*c* is provided in the outer periphery of the pressuring chamber of the cylinder 6. While the cylinder 6 applies a force toward a low pressure fuel chamber 10*c* by pressuring the fuel of the pressuring chamber 11, the cylinder 6 is prevented from escaping toward the low pressure fuel chamber 10*c* by providing a small diameter portion 1*a* in the pump body 1. Since both surfaces come into contact in a flat surface in an axial direction, a double sealing function is achieved in addition to the sealing of the contact cylindrical surface between the high pressure fuel supply pump 1 and the cylinder 6.

A damper cover 14 is fixed to the head of the high pressure fuel supply pump 1. A suction joint 51 is provided in the damper cover 14, and the low pressure fuel inlet 10*a* is formed. The fuel passing through the low pressure fuel inlet 10*a* passes through a filter 52 which is fixed to the inside of the suction joint 51, and reaches the suction port 31*b* of the electromagnetic suction valve 300 through the pressure pulsation reduction mechanism 9 and a low pressure fuel passage 10*d*.

The suction filter 52 in the suction joint 51 serves to prevent that an external object present in an area from the fuel tank 20 to the low pressure fuel inlet 10*a* is sucked into the high pressure fuel supply pump by the flow of the fuel.

The plunger 2 includes a large diameter portion 2*a* and a small diameter portion 2*b*, and thus increases or decreases a volume of the annular low pressure fuel chamber 7*a* by the reciprocating motion of the plunger. With the communication with the low pressure fuel chamber 10 through a fuel passage 1*d* (FIG. 3), an increased and decreased volume causes a flow of the fuel from the annular low pressure fuel chamber 7*a* toward a low pressure fuel chamber 10 at the time when the plunger 2 goes down, and from the low pressure fuel chamber 10 toward the annular low pressure fuel chamber 7*a* at the time when the plunger goes up. Therefore, a function is achieved in which the flow rate of the fuel with respect to the pump in a suction process or a return process of the pump can be reduced, and the pulsation can be reduced.

The pressure pulsation reduction mechanism 9 is provided in the low pressure fuel chamber 10 to reduce the propagation of the pulsation of the pressure generated in the high pressure fuel supply pump to the fuel pipe 28 (FIG. 2). In a case where the fuel flown to the pressuring chamber 11 passes through the opened suction valve 30 again for the capacity control and then returned to the suction passage 10*d* (suction port 31*b*), the pressure pulsation occurs in the low pressure fuel chamber 10 by the fuel returning to the suction passage 10*d* (suction port 31*b*). However, the pressure pulsation reduction mechanism 9 provided in the low pressure fuel chamber 10 is a metal damper which is obtained by binding two disk-like metal plates of a corrugated shape and injected with an inactive gas such as argon. The pressure pulsation is absorbed and reduced by expanding and compressing the metal damper. An attachment metal fitting 9*b* is provided to fix the metal damper to the inner peripheral portion of the high pressure fuel supply pump 1. Since the attachment metal fitting is provided on the fuel passage, a plurality of holes are provided, and thus the fluid can freely go through the front and back sides of the attachment metal fitting 9*b*.

The discharge valve mechanism 8 provided in the output port of the pressuring chamber 11 is configured by the discharge valve seat 8*a*, the discharge valve 8*b* which comes into contact with and separates from the discharge valve seat 8*a*, the discharge valve spring 8*c* which biases the discharge valve 8*b* toward the discharge valve seat 8*a*, and a discharge valve holder 8*d* which contains the discharge valve 8*b* and the discharge valve seat 8*a*. The discharge valve seat 8*a* and the discharge valve holder 8*d* are bonded in an abutting portion 8*e* by welding, and integrated to form the discharge valve mechanism 8. Furthermore, a stepped portion 8*f* is provided in the discharge valve holder 8*d* to form a stopper which restricts a stroke of the discharge valve 8*b*.

In FIG. 1, the discharge valve 8*b* is pressed to the discharge valve seat 8*a* to be in a closed state by a biasing force of the discharge valve spring 8*c* in a state where there is no difference in fuel pressure between the pressuring chamber 11 and a fuel discharge port 12. When the fuel pressure of the pressuring chamber 11 starts to increase larger than that of the fuel discharge port 12, the discharge valve 8*b* is opened against the discharge valve spring 8*c*, and the fuel in the pressuring chamber 11 is discharged at a high pressure toward the common rail 23 through the fuel discharge port 12. When being opened, the discharge valve 8*b* comes into contact with a discharge valve stopper 8*f*, and the stroke is restricted. Therefore, the stroke of the discharge valve 8*b* is appropriately determined by the discharge valve stopper 8*d*. Therefore, since the stroke becomes too large, and the closing of the discharge valve 8*b* is delayed, it is possible to prevent that the fuel discharged at a high pressure toward the fuel discharge port 12 flows backward into the pressuring chamber 11 again. It is possible to suppress lowering of the efficiency of the high pressure fuel supply pump. In addition, when the discharge valve 8*b* is repeatedly opened and closed, the discharge valve 8*b* is guided to the inner peripheral surface of the discharge valve holder 8*d* such that the discharge valve 8*b* moves only in the stroke direction. With such a configuration, the discharge valve mechanism 8 serves as a check valve which restricts a flowing direction of the fuel.

Figure 4:
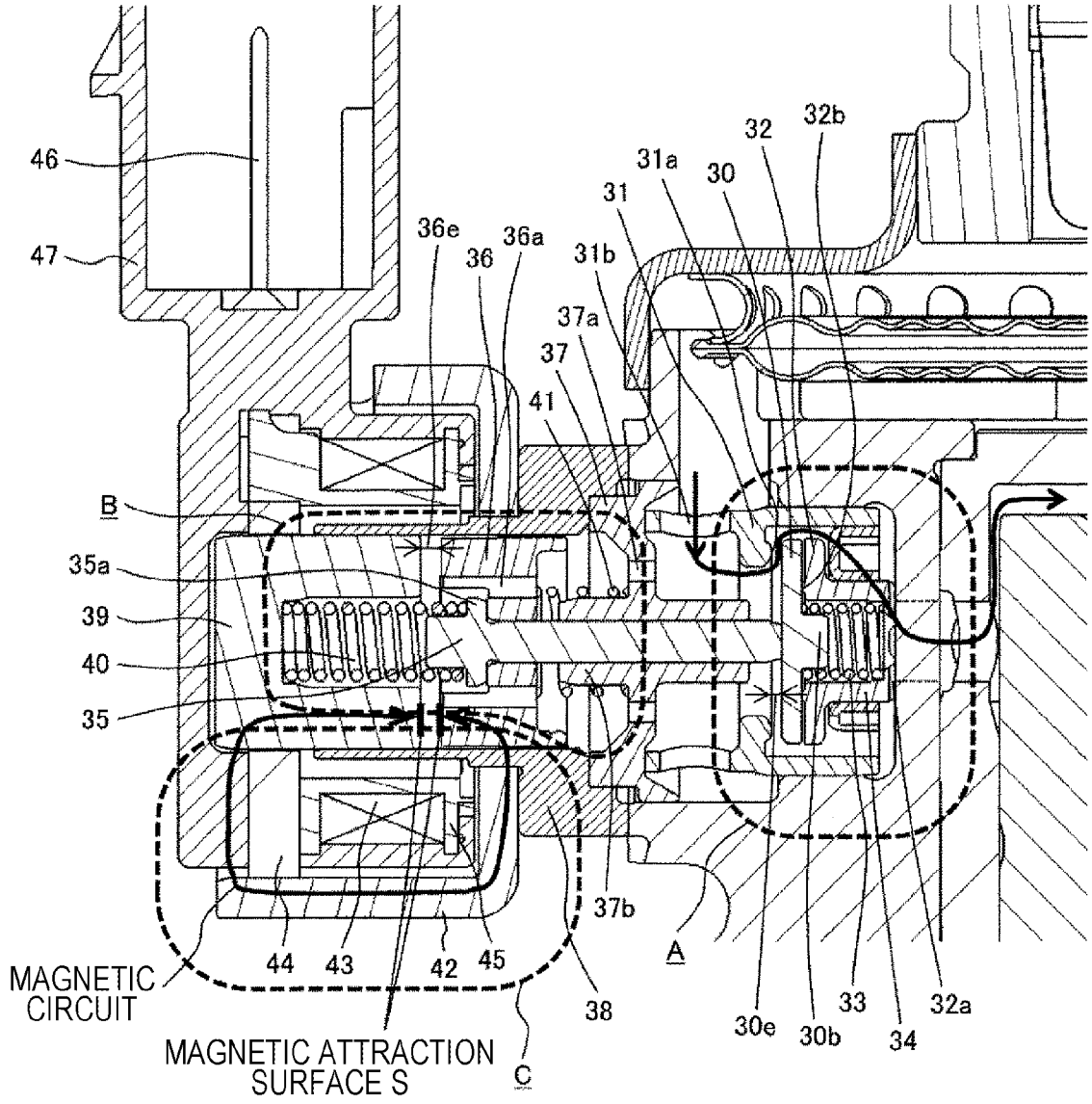
FIG. 4 is a diagram illustrating states of the respective portions in a suction process in the respective processes in a pumping operation.
Figure 5:
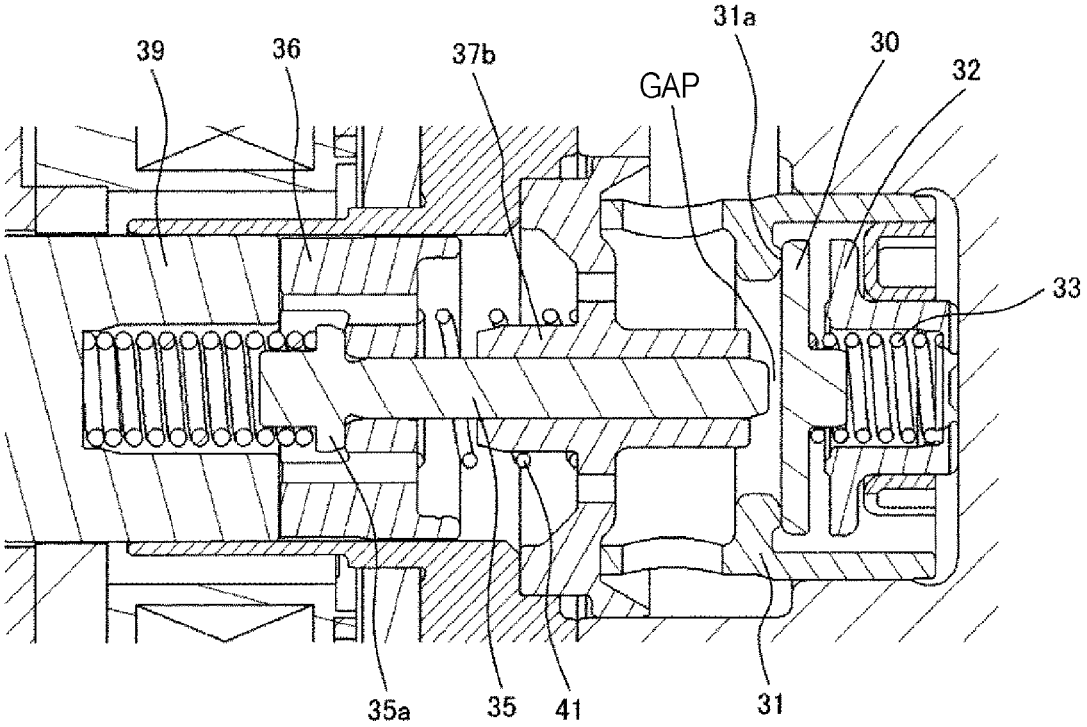
FIG. 5 is a diagram illustrating the states of the respective portions when an electromagnetic force of a discharge process is applied in the respective processes in the pumping operation.
Figure 6:
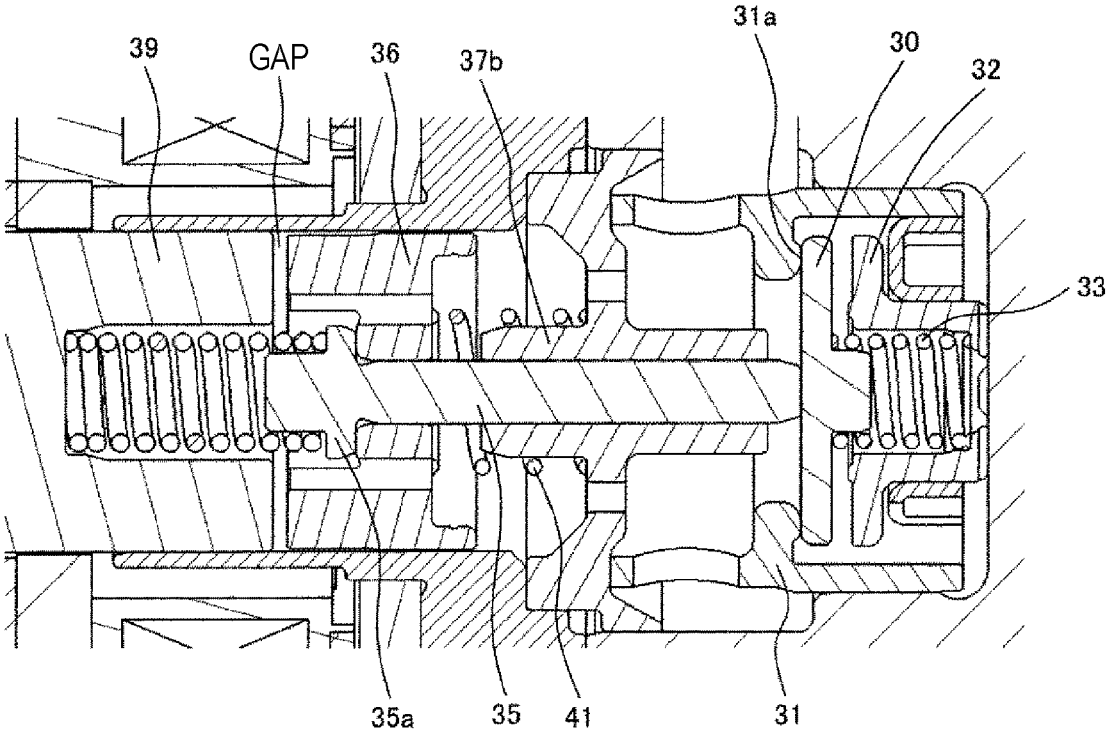
FIG. 6 is a diagram illustrating the states of the respective portions after the electromagnetic force of the discharge process is applied in the respective processes in the pumping operation.

Next, the description will be given using FIGS. 4, 5, and 6 about a structure of the electromagnetic suction valve 300 which is a main portion of the invention. Furthermore, FIG. 4 illustrates a state in the suction process among the suction, return, and discharge processes in a pumping operation, and FIGS. 5 and 6 illustrate a state of the discharge process.

First, the structure of the electromagnetic suction valve 300 will be described using FIG. 4. The structure of the electromagnetic suction valve 300 will be roughly described about a suction valve portion A which is mainly configured by the suction valve 30, a solenoid mechanism portion B which is mainly configured by the rod 35 and the anchor 36, and a coil portion C which is mainly configured by the electromagnetic coil 43.

First, the suction valve portion A is configured by the suction valve 30, a suction valve seat 31, a suction valve stopper 32, a suction valve biasing spring 33, and a suction valve holder 34. Among them, the suction valve seat 31 is a cylindrical shape, and includes a seat portion 31*a* in a shaft direction toward the inner periphery and one or two or more suction passages 31*b* having a radial shape about the shaft of the cylinder as the center. The suction valve seat is pressed and held by the high pressure fuel supply pump 1 in the surface of the outer peripheral cylinder.

The suction valve holder 34 has radial claws in two or more directions, the outer periphery of the claw is coaxially fitted and held by the inner periphery of the suction valve seat 31. Furthermore, the suction stopper 32 which is cylindrical and has a brim shape in one end portion is pressed and held to the cylinder surface of the inner periphery of the suction valve holder 34.

The suction valve biasing spring 33 is disposed in a small diameter portion for coaxially stabilizing one end of the spring in the inner periphery of the suction valve stopper 32. The suction valve 30 is configured such that the suction valve biasing spring 33 is fitted to a valve guide portion 30*b* between the suction valve seat portion 31*a* and the suction valve stopper 32. The suction valve biasing spring 33 is a compression coil spring, and is provided such that a biasing force is generated in a direction where the suction valve 30 is pressed to the suction valve seat portion 31*a*. Any type of compression coil spring may be used as long as the biasing force can be obtained, and a plate spring having the biasing force which is integrally formed with the suction valve may be used.

With such a configuration of the suction valve portion A, in the suction process of the pump, the fuel which passes through the suction passage 31*b* and enters the inside passes between the suction valve 30 and the seat portion 31*a*, passes between the outer periphery of the suction valve 30 and the claw of the suction valve holder 34, passes through the high pressure fuel supply pump 1 and the passage of the cylinder, and flows into the pump chamber. In addition, in the discharge process of the pump, the suction valve 30 is sealed by coming into contact with the suction valve seat portion 31*a*, so that the suction valve serves as a check valve to prevent a reverse flow of the fuel toward the inlet.

Furthermore, there is provided a passage 32*a* in order to make the movement of the suction valve 30 smooth, and in order to release the fluid pressure in the inner periphery of the suction valve stopper according to the movement of the suction valve 30.

A moving amount 30*e* of the suction valve 30 in the axial direction is limitedly regulated by the suction valve stopper 32. This is because, if the moving amount is too large, the reverse flow rate becomes large due to a response delay at the time when the suction valve 30 is closed, and thus the performance as the pump is degraded. The regulation of the moving amount can be accomplished by regulating the shape dimensions and the pressuring positions in the axial direction of the suction valve seat 31*a*, the suction valve 30, and the suction valve stopper 32.

In the suction valve stopper 32, an annual projection 32*b* is provided, and the contact area with respect to the suction valve stopper 32 becomes small in a state where the suction valve 32 is opened. This is because the suction valve 32 easily separates from the suction valve stopper 32 when it transitions from the open state to the close state (that is, in order to improve a response of the close valve). In a case where there is no annual projection (that is, the contact area is large), a large squeeze force is applied between the suction valve 30 and the suction valve stopper 32, and the suction valve 30 hardly separates from the suction valve 32.

The suction valve 30, the suction valve seat 31*a*, the suction valve stopper 32 repeatedly come into conflict to each other, and thus are made of a material obtained by thermally processing a martensite-based stainless material which has high strength and high hardness and excellent even on corrosion resistance. The suction valve spring 33 and the suction valve holder 34 are made of an austenite-based stainless material in consideration of corrosion resistance.

Next, the solenoid mechanism portion B will be described. The solenoid mechanism portion B is made of the movable rod 35, the anchor 36, a fixed rod guide 37, a first core 38, a second core 39, the rod biasing spring 40, and the anchor biasing spring 41.

The movable rod 35 and the anchor 36 are configured by separated members. The rod 35 is held on the inner periphery of the rod guide 37 in the axial direction to be freely slidable. The inner periphery of the anchor 36 is held on the outer periphery of the rod 35 to be freely slidable in other words, the rod 35 and the anchor 36 both are configured to be freely slidable in the axial direction in a geometrically regulated range.

The anchor 36 includes one or more through holes 36*a* in the axial direction to smoothly move freely in the axial direction in the fuel, and extremely prevents the regulation on the movement caused by a difference in pressure before and after the anchor.

The rod guide 37 is disposed to be inserted into a hole where the suction valve of the high pressure fuel supply pump 1 is inserted in the radial direction, to abut on the one end of the suction valve seat in the axial direction, and to be interposed between the first core 38 welded and fixed to the high pressure fuel supply pump 1 and the high pressure fuel supply pump 1. Similarly to the anchor 36, the rod guide 37 is also provided with a through hole 37*a* passing through in the axial direction, and is configured such that the anchor can smoothly move freely and not to cause the pressure of the fuel chamber on a side near the anchor to prevent the moving of the anchor.

The shape of the first core 38 on a side opposite to the portion to be welded with the high pressure fuel supply pump is a thin cylindrical shape. The second core 39 is welded and fixed to the inner periphery of the first core to be inserted therein. The rod biasing spring 40 is disposed in the inner periphery of the second core 39 to guide the small diameter portion. The rod 35 comes into contact with the suction valve 30. The biasing force is applied in a direction separating the suction valve from the suction valve seat portion 31*a* (that is, a direction opening the suction valve).

The anchor biasing spring 41 is disposed to apply the biasing force to the anchor 36 in a direction toward a rod brim portion 35*a* while coaxially inserting one end in the cylindrical guide portion 37*a* provided in the center of the rod guide 37.

A moving amount 36*e* of the anchor 36 is set to be larger than the moving amount 30*e* of the suction valve 30. This is because the suction valve 30 is securely closed.

Since the rod 35 and the rod guide 37 slide to each other, and the rod 35 repeatedly comes into conflict with the suction valve 30, the rod is made of a material obtained by thermally processing a martensite-based stainless material in consideration of hardness and corrosion resistance. The anchor 36 and the second core 39 are made using a magnetic stainless material for forming a magnetic circuit, and the respective conflict surfaces of the anchor 36 and the second core are subjected to surface treatment for improving the hardness. In particular, a hard Cr plating is used, but not limited. The rod biasing spring 40 and the anchor biasing spring 41 are made of an austenite-based stainless material in consideration of corrosion resistance.

According to the above configuration, three springs are organically disposed in the suction valve portion A and the solenoid mechanism portion B. The suction valve biasing spring 33 configured in the suction valve portion A, the rod biasing spring 40 configured in the solenoid mechanism portion B, and the anchor biasing spring 41 correspond to these springs. While the coil springs are used for all the springs in this embodiment, any other configuration may be used as long as the biasing force can be obtained.

A relation between the forces of these three springs is expressed by the following expression.

[Expression 1]

$$\text{Force of rod biasing spring 40} > \text{Force of anchor biasing spring 41} + \text{Force of suction valve biasing spring 33} + \text{Force of closing suction valve by fluid} \quad (1)$$

According to the relation of Expression (1), the respective spring forces cause the rod 35 to apply a force f1 in a direction separating the suction valve 30 from the suction valve seat portion 31*a* (that is, a direction opening the valve) during non-energization. The force f1 in a direction opening the valve is expressed by the following Expression (2) on the basis of Expression (1).

[Expression 2]

$$f1 = \text{Force of rod biasing spring} - (\text{Force of anchor biasing spring} + \text{Force of suction valve biasing spring} + \text{Force of closing suction valve by fluid}) \quad (2)$$

Finally, the configuration of the coil portion C will be described. The coil portion C is made of a first yoke 42, the electromagnetic coil 43, a second yoke 44, a bobbin 45, a terminal 46, and a connector 47. The coil 43 in which copper line is wound about the bobbin 45 in plural times is disposed to be surrounded by the first yoke 42 and the second yoke 44, and molded and fixed integrally with a resin connector. The respective one ends of two terminals 46 are electrically connected to both ends of the copper line of the coil. Similarly, the terminal 46 is also molded integrally with the connector, and the other end is configured to be connected to the engine control unit.

The coil portion C is configured such that the hole in the center portion of the first yoke 42 is pressed and fixed to the first core A. At that time, the inner periphery of the second yoke 44 is configured to come into contact with the second core or approach the second core with a slight clearance therebetween.

The first yoke 42 and the second yoke 44 both are made of a magnetic stainless material in consideration of corrosion resistance in order to form the magnetic circuit. The bobbin 45 and the connector 47 are made of a high hardness and heat resistance resin in consideration of hardness and heat resistance. A material plated with copper is used for the coil 43, and a material plated with brass is used for the terminal 46.

As described above, with the configurations of the solenoid mechanism portion B and the coil portion C, the magnetic circuit is formed by the first core 38, the first yoke 42, the second yoke 44, the second core 39, and the anchor 36 as depicted by the arrow portion of FIG. 4. When the current flows to the coil, the electromagnetic force is generated between the second core 39 and the anchor 36, and a force drawing each other is generated. In the first core 38, almost all the magnetic flux passes through between the second core and the anchor by making the portion extremely thin in the axial direction where the attraction force is generated to each other between the second core 39 and the anchor 36. Therefore, the electromagnetic force can be obtained with efficiency.

When the electromagnetic force exceeds the force f1 in the direction opening the valve denoted in Expression (2), the movable anchor 36 can move to be drawn to the second core 39 together with the rod 35, and the core 39 comes into contact with the anchor 36 and can keep the contact.

According to the configuration of the high pressure fuel supply pump of the invention, the following operations are performed in the respective suction, return, and discharge processes in the pumping operation.

First, the suction process will be described. In the suction process, the plunger 2 moves in a direction of the cam 93 while the cam 93 of FIG. 3 rotates (the plunger 2 goes down). In other words, the position of the plunger 2 moves from a top dead center to a bottom dead center. Making an explanation with reference to FIG. 1, at the time of a state of the suction process, the volume of the pressuring chamber 11 is increased and the fuel pressure in the pressuring chamber 11 is lowered. In this process, when the fuel pressure in the pressuring chamber 11 becomes lower than the pressure of the suction passage 10*d*, the fuel passes through the suction valve 30 in the open state, passes through a communication hole 1*b* provided in the high pressure fuel supply pump 1 and passages 6*a* and 6*b* in the outer periphery of the cylinder, and flows into the pressuring chamber 11.

FIG. 4 illustrates a positional relation of the respective portions in the electromagnetic suction valve 300 in the suction process. The description will be given with reference to FIG. 4. In this state, the electromagnetic coil 43 is kept in the non-energization state, and the magnetic biasing force is not operated. Therefore, the suction valve 30 is caused by the biasing force of the rod biasing spring 40 to enter a state of being pressured by the rod 35, and is kept opened.

Next, the return process will be described. In the return process, the plunger 2 moves in the upward direction while the cam 93 of FIG. 3 rotates. In other words, the position of the plunger 2 starts to move from the bottom dead center toward the top dead center. The volume of the pressuring chamber 11 at this time is reduced according to a compression motion after the suction in the plunger 2. However, in this state, the fuel sucked into the pressuring chamber 11 returns toward the suction passage 10*d* through the suction valve 30 in the open state again. Therefore, the pressure of the pressuring chamber is not increased. This process is called the return process.

In this state, when the control signal from the engine control unit 27 (hereinafter, referred to as an engine control unit) is applied to the electromagnetic suction valve 300, the process transitions from the return process to the discharge process. When the control signal is applied to the electromagnetic suction valve 300, the electromagnetic force is generated in the coil portion C, and this force is operated on the respective portions. FIG. 5 illustrates a positional relation of the respective portions in the electromagnetic suction valve 300 at the time when the electromagnetic force is operated. The description will be given with reference to FIG. 5.

In this state, the magnetic circuit is formed by the first core 38, the first yoke 42, the second yoke 44, the second core 39, and the anchor 36. When the current flows to the coil, the electromagnetic force is generated between the second core 39 and the anchor 36, and a force of drawing each other is generated. When the anchor 36 is attracted to the fixed second core 39, the rod 35 moves in a direction separating from the suction valve 30 by an engaged mechanism between the anchor 36 and the rod brim portion 35*a*. At this time, the suction valve 30 is closed by a fluid force caused by the biasing force of the suction valve biasing spring 33 and by the flowing of fuel to the suction passage 10*d*. After the valve is closed, the fuel pressure of the pressuring chamber 11 rises along with the rising motion of the plunger 2. When the fuel pressure is equal to or more than the pressure of the fuel discharge port 12, the fuel is discharged at a high pressure through the discharge valve mechanism 8, and supplied to the common rail 23. This process is called the discharge process.

In other words, the compression process of the plunger 2 (the rising process from the bottom dead center to the top dead center) includes the return process and the discharge process. Then, the amount of fuel to be discharged at a high pressure can be controlled by controlling a timing of energizing the coil 43 of the electromagnetic suction valve 300. When the timing of energizing the electromagnetic coil 43 is earlier, a ratio of the return process in the compression process is decreased, and a ratio of the discharge process is increased. In other words, the fuel returning to the suction passage 10*d* becomes less, and the fuel discharged at a high pressure becomes more. On the other hand, when the timing of energizing is delayed, the ratio of the return process in the compression process is increased, and the ratio of the discharge process is decreased. In other words, the fuel returning to the suction passage 10*d* becomes more, and the fuel discharged at a high pressure becomes less. The timing of energizing the electromagnetic coil 43 is controlled by a command from the engine control unit 27.

With such a configuration as described above, the amount of fuel discharged at a high pressure can be controlled to be an amount required by the internal combustion engine by controlling the timing of energizing the electromagnetic coil 43.

FIG. 6 illustrates a positional relation of the respective portions in the electromagnetic suction valve 300 in the discharge process. Herein, there is illustrated a state of non-energization in which the energizing of the electromagnetic coil 43 is released in a state where the suction valve is closed after the pressure of the pump chamber is sufficiently increased. In this state, the system is configured to prepare for the next process, generate the electromagnetic force at the next step, and effectively perform the operation. The invention is characterized in such a system preparation. An advantage of realizing the state of FIG. 6 will be described with reference to the timing chart of FIG. 7.

Figure 7:
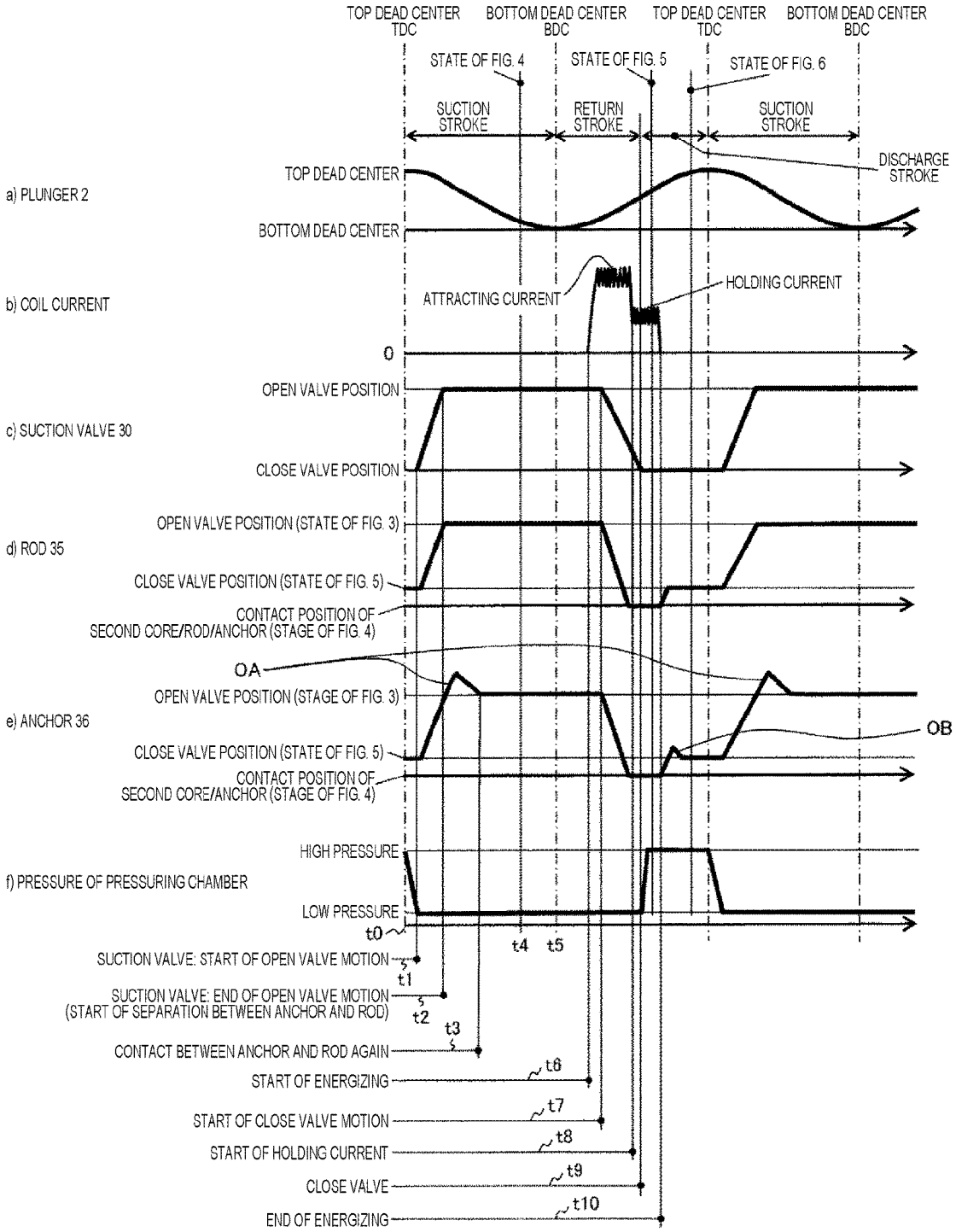
FIG. 7 is a timing chart illustrating the states of the respective portions in the respective processes in the pumping operation.

The timing chart of FIG. 7 shows a) the position of the plunger 2, b) the coil current, C) the position of the suction valve 30, d) the position of the rod 35, e) the position of the anchor 36, and f) the pressure in the pressuring chamber in an order descending from the upside. In addition, the horizontal axis time-sequentially shows time t in one cycle from the suction process to the suction process through the return process and the discharge process.

According to a) the position of the plunger 2 of FIG. 7, the suction process is a period in which the position of the plunger 2 reaches to the bottom dead center from the top dead center. The period of the return process and the discharge process is a period in which the position of the plunger 2 reaches the top dead center from the bottom dead center. In addition, according to b) the coil current, the attracting current flows to the coil during the return process, and subsequently it transitions to the discharge process during the state where the holding current is flowing.

Furthermore, C) the position of the suction valve 30, d) the position of the rod 35, and e) the position of the anchor 36 are changed as the electromagnetic force is generated when the coil current is energized, and return to the original positions in the initial state of the suction process. With these positional changes, f) pressure in the pressuring chamber becomes high in a period of the discharge process.

Hereinafter, the description will be given about a relation between the operations of the respective portions in the respective processes and the physical quantities at that time. First, in the suction process, when the plunger 2 starts to go down from the top dead center at time t0, f) the pressure in the pressuring chamber rapidly becomes small from the state of a high pressure of a 20 MPa level for example. As the pressure is lowered, the rod 35, the anchor 36, and the suction valve 30 at time t1 start to move in the direction opening the suction valve 30 by the force f1 in the direction opening the valve of Equation (2) described above. The suction valve 30 is completely opened at time t2, and the rod 35 and the anchor 36 enter an open valve position state of FIG. 3. Therefore, the fuel flown into the inner diameter side of the valve seat 31 from the passage 31*b* of the suction valve seat by opening the suction valve 30 starts to flow into the pressuring chamber.

When moving at the beginning of the suction process, the suction valve 30 comes into conflict with the suction valve stopper 32. The suction valve 30 stops at the position. Similarly, the tip end of the rod 35 also stops at the position abutting on the suction valve 30 (the open valve position of the plunger rod in FIG. 7).

On the contrary, the anchor 36 moves in the direction opening the suction valve 30 at the same speed as that of the rod 35. However, even after the rod 35 abuts on the suction valve 30 and stops at time t2, the anchor keeps moving by its inertia force. The portion indicated by "OA" of FIG. 7 is an area of overshoot. At the overshoot, the anchor biasing spring 41 overcomes the inertia force, the anchor 36 moves again in a direction approaching the second core 39, and the anchor 36 is pressed to the rod brim portion 35*a* and stops at that position (the open valve position of the anchor in FIG. 7). The stop time of the anchor 36 caused by the re-abutting between the rod 35 and the anchor 36 is denoted by t3. FIG. 4 illustrates the respective positions of the anchor 36, the rod 35, and the suction valve 30 at time t4 in a stable state at the stop time t3 onwards.

Furthermore, the description has been made that the rod 35 and the anchor 36 completely separate in the portion indicated by "OA" in FIG. 7, but the rod 35 and the anchor 36 may be kept in a contact state. In other words, a load applied on the abutting portion between the rod brim portion 35*a* and the anchor 36 is reduced after the rod stops. When the load becomes zero, the anchor 36 starts to separate from the rod. However, a force of the anchor biasing spring 41 may be set to leave a small amount of load without making zero.

When the suction valve 30 comes into conflict with the suction valve stopper 32, an abnormal sound problem occurs which is an important characteristic as a product. The magnitude of the abnormal sound is caused by the magnitude of energy at the time of the conflict. However, since the rod 35 and the anchor 36 are separately configured in the invention, collision energy with respect to the suction valve stopper 32 is generated only by the mass of the suction valve 30 and the mass of the rod 35. Since the mass of the anchor 36 does not contribute to the collision energy, the abnormal sound problem can be reduced by configuring the rod 35 and the anchor 36 separately.

Furthermore, even though the rod 35 and the anchor 36 are separately configured, in a case where the anchor biasing spring 41 is not provided, the anchor 36 keeps moving in the direction opening the suction valve 30 by the inertia force, comes in conflict with the center bearing portion 37*a* of the rod guide 37, and causes the abnormal sound in a portion other than the collision portion. In addition to the abnormal sound problem, the anchor 36 and the rod guide 37 are abraded and deformed by the collision, and also metal matters are generated by the abrasion. When the matters are interposed between the sliding portion and the seat portion, or when the bearing function is degraded due to the deformation, there is a concern that the function of solenoid mechanism of the suction valve is degraded.

In addition, in the case of the configuration having no anchor biasing spring 41, the anchor separates too much from the core 39 due to the inertia force (the GA portion of FIG. 7). Therefore, there is a problem in that a necessary electromagnetic attraction force is not obtained at the time when the current is added to the coil portion to transition from the return process to the discharge process which are post-processes in time. In a case where a necessary electromagnetic attraction force is not obtained, there is a big problem in that the fuel discharged from the high pressure fuel supply pump is not controllable to be a desired flow rate.

Therefore, the anchor biasing spring 41 has an important function not to generate the above problem.

After the suction valve 30 is opened, the plunger 2 further goes down and reaches the bottom dead center (time t5). Meanwhile, the fuel keeps flowing in the pressuring chamber 11, and this process is the suction process. The plunger 2 that has gone down to the bottom dead center enters the rising process, and moves to the return process.

At this time, the suction valve 30 stops in the open state by the force f1 in the direction opening the valve, and the direction where the fluid passes through the suction valve 30 becomes completely opposite. In other words, while the fuel flows from the suction valve seat passage 31*b* to the pressuring chamber 11 in the suction process, the fuel returns to the direction from the pressuring chamber 11 to the suction valve seat passage 31*b* at the time of the rising process. This process is the return process.

In the return process, at the time of high rotation of the engine (that is, on a condition that the rising speed of the plunger 2 is large), a valve closing force of the suction valve 30 caused by the returned fluid is increased, the force f1 in the direction opening the valve becomes small. In this condition, in a case where the setting forces of the respective spring forces wrongly make the force f1 in the direction opening the valve have a negative value, the suction valve 30 comes to be unintentionally closed. Since the amount of flow rate larger than a desired discharge flow rate is discharged, the pressure in the fuel pipe is increased to be equal to or more than a desired pressure, and an adverse effect is asserted on a combustion control of the engine. Therefore, it is necessary that the respective spring forces be set to make the force f1 in the direction opening the valve have a positive valve on a condition that the rising speed of the plunger 2 is maximized.

The current is supplied to the coil at time t6 in the middle of the return process, and thus the state transition from the return process to the discharge process is realized. Furthermore, t7 in FIG. 7 means a time to start to close the suction valve 30, t8 means a time to start to hold the current, t9 means a time to close the suction valve 30, and t10 means a time to end the energizing.

In this case, when the electromagnetic force is generated later even than a desired discharge time, and the current is supplied to the electromagnetic coil 43 earlier in consideration of the close delay of the suction valve 30, the magnetic attraction force between the anchor 36 and the second core 39 is applied. There is a need to supply a current larger enough to overcome the force f1 in the direction opening the valve. The anchor 36 starts to move in a direction toward the second core 39 at time t7 when the magnetic attraction force overcomes the force f1 in the direction opening the valve. When the anchor 36 moves, the rod 35 into contact with the brim portion 35*a* also moves in the axial direction, the suction valve 30 starts to be closed (time t9) by the decrease in static pressure due to the force of the suction valve biasing spring 33 and the fluid force and mainly due to the flow rate passing through the seat portion from the pressuring chamber.

In a case where the anchor 36 and the second core 39 separate away from each other more than a defined distance when the current is supplied to the electromagnetic coil 43 (that is, a case where the anchor 36 exceeds the "open valve position" of FIG. 7 and the OA state is kept on), the magnetic attraction force is weak and thus cannot overcome the force f1 in the direction opening the valve. Further, it takes a time for the anchor 36 to move toward the second core 39, or the movement is not possible.

The invention provides the anchor biasing spring 41 in order not to cause such a problem. In a case where the anchor 36 is not possible to move to the second core 39 at a desired timing, the suction valve is kept in the open state even at the timing of discharge. Therefore, since the discharge process is not possible to start (that is, it is not possible to obtain a required amount of discharge), there is a concern that a desired engine combustion is not possible. Therefore, the anchor biasing spring 41 has an important function in order to prevent the abnormal sound problem which may occur in the suction process, and to prevent a problem that the discharge process does not start.

In FIG. 7, C) the suction valve 30 which starts to move comes into conflict with the seat portion 31*a* and stops to enter the close state. When the valve is closed, the pressure in the cylinder is rapidly increased. Therefore, the suction valve 30 is pressed strongly in the direction closing the valve with a force significantly larger than the force f1 in the direction opening the valve, and starts to keep the close state.

Even e) the anchor 36 comes into conflict with the second core 39 and stops. While the rod 35 keeps moving by the inertia force even after the anchor 36 stops, the rod returns when the rod biasing spring 40 overcomes the inertia force, and the brim portion 35*a* can return to the position to come into contact with the anchor.

When the anchor 36 comes into conflict with the second core 39, there occurs a problem of the abnormal sound which is an important characteristic as a product. The abnormal sound will be a bigger problem when the sound becomes larger than that caused by the conflict between the suction valve and the suction valve stopper. While the magnitude of the abnormal sound is caused by the magnitude of energy at the time of conflict, the collision energy with respect to the second core 39 is generated only by the mass of the anchor 36 since the rod 35 and the anchor 36 are separately configured. In other words, the mass of the rod 35 does not contribute to the collision energy, so that the problem of the abnormal sound is reduced by separately providing the rod 35 and the anchor 36.

Since a sufficient magnetic attraction force is generated by the contact after time t8 when the anchor 36 comes into contact with the second core 39 once, it is possible to set the current value (holding current) as small as to hold the contact.

Herein, the description will be given about an erosion problem which may occur in the solenoid mechanism portion B. When the current is supplied to the coil, and the anchor 36 is drawn to the second core 39, the volume of the space between two objects is rapidly reduced, and thus there is nowhere for the fluid in the space. Therefore, the fluid rapidly flows out to the outer periphery of the anchor, and comes into conflict with the thin portion of the first core, so that the energy may cause the erosion problem. In addition, the flowing-out fluid passes through the outer periphery of the anchor and flows toward the rod guide. However, the flow rate becomes large since the passage toward the outer periphery of the anchor is narrow. In other words, a cavitation occurs as the static pressure is rapidly lowered, and a cavitation erosion may occur in the thin portion of the first core.

In order to avoid these problems, the through holes 36*a* (FIG. 4) are provided in one or more axial directions in the center portion of the anchor. The through hole 36*a* is provided to forcibly make the fluid in the space pass therethrough in order not to pass through the narrow passage in the outer periphery of the anchor when the anchor 36 is drawn toward the second core 39. With such a configuration, the erosion problem can be solved.

In a case where the anchor 36 and the rod 35 are integrally configured, the problem may be caused. At the time of high rotation of the engine (that is, on a condition that the rising speed of the plunger is large), the current is supplied to the coil and a force to close the suction valve 30 caused by the fluid having a significantly large speed is increasingly added to a force of the anchor 36 to move to the second core 39, and the rod 35 and the anchor 36 rapidly approach toward the second core 39. Therefore, the speed that the fluid flows out of the space is further increased, and thus the erosion problem may be increased further more. In a case where the capacity of the through hole 36*a* of the anchor 36 is insufficient, the erosion problem may be not solved.

In the embodiment of the invention, since the anchor 36 and the rod 35 are separately configured, only the rod 35 is pressed toward the second core 39 even in a case where the force to close the suction valve 30 is applied to the rod 35, and thus the rod moves toward the second core 39 only by a normal electromagnetic attraction force while the anchor 36 is left. In other words, the space is not rapidly reduced, and the erosion problem can be prevented.

Even though a desired magnetic attraction force is not obtained, and there are problems such as the abnormal sound and functional degradation due to the configuration that the anchor 36 and the rod 35 are separately configured as described above, these problems can be removed by providing the anchor biasing spring 41 in the embodiment of the invention.

Next, the discharge process will be described. In FIG. 7, the plunger transitions to the rising process from the bottom dead center, the current is supplied to the coil 43 at a desired timing, and the pressure in the pressuring chamber is rapidly increased immediately after the return process ends until the suction valve 30 is closed, and then the plunger enters the discharge process.

After the discharge process, the current supplied to the coil is not supplied since the power supplied to the coil is necessarily reduced in viewpoint of power saving. With this configuration, the electromagnetic force disappears, and the anchor 36 and the rod 35 move in a direction away from the second core 39 by a resultant force of the rod biasing spring 40 and the anchor biasing spring 41. However, since the suction valve 30 is at a close valve position with a strong valve closing force, the rod 35 stops at a position where it comes into conflict with the suction valve 30 in the close state. In other words, a moving amount of the rod at that time becomes 36*e*-30*e* of FIG. 4.

The rod 35 and the anchor 36 move at the same time after the current does not flow. Even after the rod 35 stops in a state where the tip end of the rod 35 and the closed suction valve 30 come into contact with each other, the anchor 36 keeps moving in a direction toward the suction valve 30 by the inertia force. "OB" of FIG. 7 illustrates such a state. However, since the anchor biasing spring 41 overcomes the inertia force and gives the biasing force to the anchor 36 in a direction toward the second core 39, the anchor 36 can stop in a state of coming into contact with the brim portion 35*a* of the rod 35 (the state of FIG. 6).

In a case where there is no anchor biasing spring 41, as described above about the suction process, the anchor moves in a direction toward the suction valve 30 without stopping, and the abnormal sound problem caused by the conflict with the valve seat 37 and the functional failure problem are concerned. With the anchor biasing spring 41 according to the invention, these problems can be prevented.

In this way, the discharge process is performed to discharge the fuel, and the suction valve 30, the rod 35, and the anchor 36 enter the state of FIG. 6 immediately before the next suction process.

The discharge process ends at the time when the plunger reaches the top dead center, and the suction process starts again.

Therefore, it is possible to provide a high pressure fuel supply pump which presses a required amount of the fuel guided to the low pressure fuel inlet 10*a* at a high pressure by the reciprocating motion of the plunger 2 in the pressuring chamber 11 of the pump body 1 as the pump body, and is suitable to pump the fuel from the fuel discharge port 12 to the common rail 23.

Further, since the suction valve 30 is necessarily closed early, it is desirable that the spring force of the suction valve spring 33 be significantly large, and the spring force of the anchor biasing spring 41 be small. With this configuration, it is possible to inhibit the deterioration of flow rate efficiency caused by the delay in closing the suction valve 30.

Second Embodiment

Figure 8:
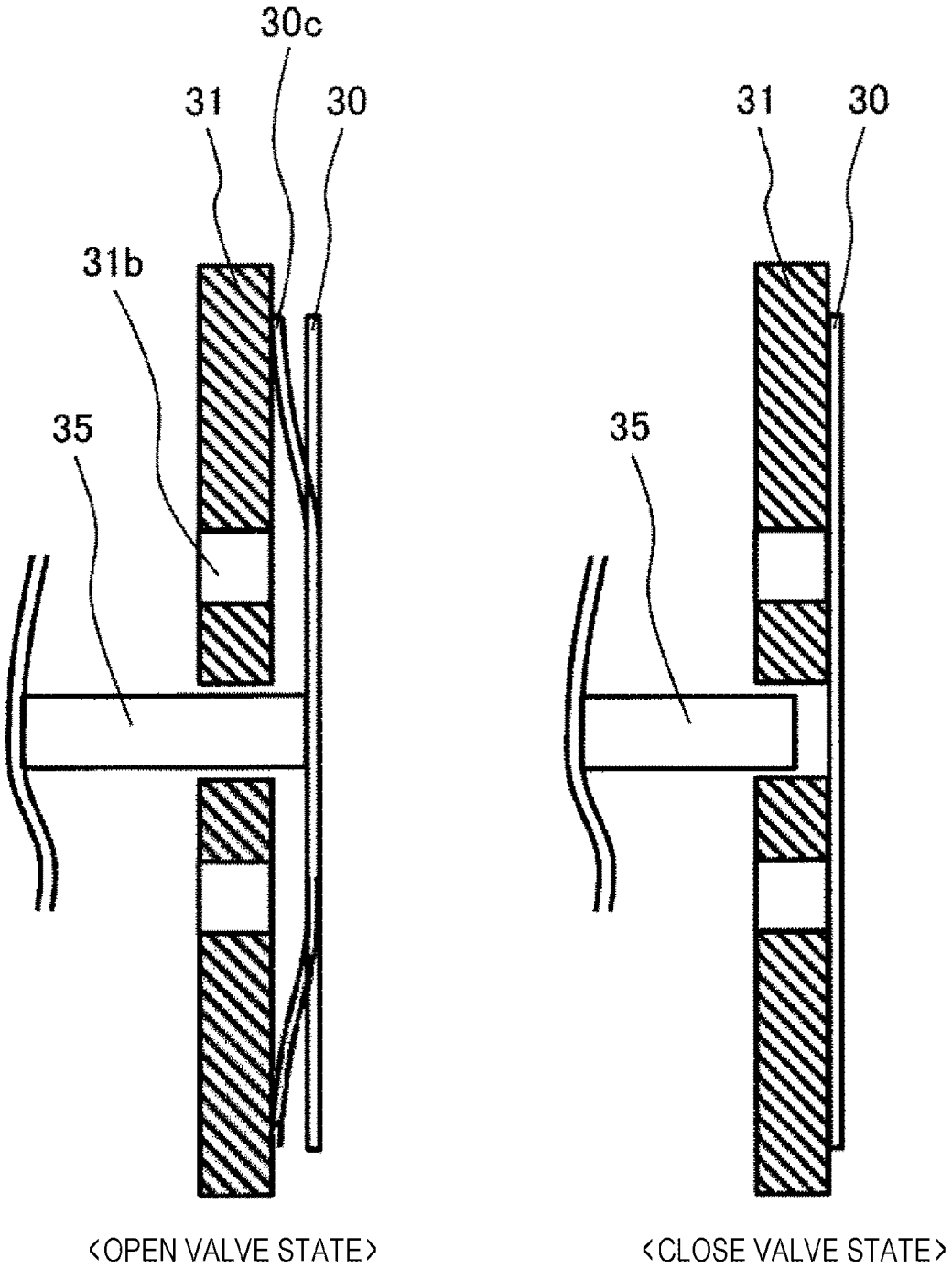
FIG. 8 is a cross-sectional view of an electromagnetic suction valve of the high pressure fuel supply pump according to a second embodiment of the invention.

FIG. 8 illustrates another embodiment of the suction valve portion. The suction valve 30 is provided with a spring portion 30*c* giving a biasing force to the suction valve 30 itself, and assembled to the suction valve seat 31 having the suction valve seat passage 31*b*, so that the suction valve mechanism is configured.

The spring portion 30*c* corresponds to the suction valve biasing spring 33 in the first embodiment, and exerts the similar operations and effects as those of the electromagnetic suction valve 300 illustrated in the first embodiment.

REFERENCE SIGNS LIST

1: pump body
2: plunger
6: cylinder
7: seal holder
8: discharge valve mechanism
9: pressure pulsation reduction mechanism
10*a*: low pressure fuel inlet
11: pressuring chamber
12: fuel discharge port
13: plunger seal
30: suction valve
31: suction valve seat
33: suction valve spring
35: rod
36: anchor
38: first core
39: second core
40: rod biasing spring
41: anchor biasing spring
43: electromagnetic coil
300: electromagnetic suction valve

The invention claimed is:

1. A high pressure fuel supply pump, comprising:

an electromagnetic suction valve that adjusts an amount of fuel sucked into a pressuring chamber;

a discharge valve that discharges the fuel from the pressuring chamber; and a plunger that is able to make a reciprocating motion in the pressuring chamber, wherein the electromagnetic suction valve includes an electromagnetic coil, a suction valve, and a movable portion that is able to be operated in a direction closing the suction valve by a magnetic attraction force when the electromagnetic coil is energized, wherein the movable portion includes an anchor portion that is driven in a direction closing the suction valve by the magnetic attraction force and comes into conflict with a fixed member to stop moving, and a rod portion that is driven in conjunction with the anchor portion and is able to keep its moving even after the anchor portion stops moving, wherein the electromagnetic suction valve includes a first spring that biases the suction valve in a direction to be closed, a second spring that biases the suction valve through the rod portion in a direction to be opened, and a third spring in the anchor portion that indirectly gives the rod portion a force pressing the rod, wherein the anchor portion is released from the magnetic attraction force, and moves together with the rod portion in a direction opening the valve, and wherein after the rod portion stops, the anchor stops the motion by the third spring and by contacting the rod portion.

2. The high pressure fuel supply pump according to claim 1, wherein a biasing force of the second spring is larger than a resultant force of a biasing force of the first spring and a biasing force of the third spring.

3. The high pressure fuel supply pump according to claim 1, wherein the magnetic attraction force is generated in the anchor portion by energizing the electromagnetic suction valve.

4. The high pressure fuel supply pump according to claim 1, wherein the rod portion stops moving by the biasing force of the second spring after the anchor portion stops moving.

5. The high pressure fuel supply pump according to claim 1, wherein the anchor portion and the rod portion are slidable held to each other.

6. The high pressure fuel supply pump according to claim 5, wherein the rod portion is inserted to a slidable hole of the anchor portion.

7. The high pressure fuel supply pump according to claim 1, wherein the rod portion includes a stopper portion, and the stopper portion of the rod portion is engaged with the anchor portion and makes a valve closing motion together with the anchor portion when the anchor portion performs the valve closing motion.

8. The high pressure fuel supply pump according to claim 1, wherein the third spring is coaxially disposed in an outer peripheral portion of the rod portion.

9. The high pressure fuel supply pump according to claim 1, wherein the first spring is integrally configured with the valve.

10. The high pressure fuel supply pump according to claim 9, wherein the valve is a plate spring, and one surface of the plate spring comes into contact with another seat member to form a valve structure.

11. The high pressure fuel supply pump according to claim 1, wherein a biasing force of the third spring is smaller than that of the first spring.

12. A high pressure fuel supply pump, comprising:

an electromagnetic suction valve that adjusts an amount of fuel sucked into a pressuring chamber;

a discharge valve that discharges the fuel from the pressuring chamber; and a plunger that is able to make a reciprocating motion in the pressuring chamber, wherein the electromagnetic suction valve includes an electromagnetic coil, a suction valve, and a movable portion that is able to be operated in a direction closing the suction valve by a magnetic attraction force when the electromagnetic coil is energized, wherein the movable portion includes an anchor portion that is driven in a direction closing the suction valve by the magnetic attraction force and comes into conflict with a fixed member to stop moving, and a rod portion that is driven in conjunction with the anchor portion and is able to keep its moving even after the anchor portion stops moving, wherein the electromagnetic suction valve includes a first spring that biases the suction valve in a direction to be closed, a second spring that biases the suction valve through the rod portion in a direction to be opened, and a portion that sets a gap between the anchor portion and the fixed member to be at a predetermined position after the electromagnetic coil is energized, and wherein the anchor portion is released from the magnetic attraction force, and moves together with the rod portion in a direction opening the valve, and wherein after the rod portion stops, the anchor stops the motion by a third spring in the anchor portion and by contacting the rod portion.

* * * * *